US007285739B1

(12) United States Patent
Chen

(10) Patent No.: US 7,285,739 B1
(45) Date of Patent: Oct. 23, 2007

(54) WATERPROOF STRUCTURE FOR SWITCH PINS

(75) Inventor: Kuo-Ming Chen, Taipei Hsien (TW)

(73) Assignee: Zippy Technology Corp., Taipei Hsien (TW)

( * ) Notice: Subject to any disclaimer, the term of this patent is extended or adjusted under 35 U.S.C. 154(b) by 0 days.

(21) Appl. No.: 11/394,107

(22) Filed: Mar. 31, 2006

(51) Int. Cl.
*H01H 9/00* (2006.01)

(52) U.S. Cl. ..... 200/302.1; 200/293; 200/302.2; 200/302.3; 29/856

(58) Field of Classification Search ..... 29/622, 29/854–856, 887; 174/52.1, 52.2; 200/293, 200/294, 302.1–302.3, 303, 307, 273, 274
See application file for complete search history.

(56) References Cited

U.S. PATENT DOCUMENTS 3,290,475 A * 12/1966 Bross ..... 200/293
4,877,930 A * 10/1989 Fukuma ..... 200/302.2
4,901,189 A * 2/1990 Merriman et al. ..... 361/119
5,231,758 A * 8/1993 Schauer ..... 29/856
5,552,570 A * 9/1996 Shinohara et al. ..... 200/47
5,890,586 A * 4/1999 Adelhardt et al. ..... 200/302.1
6,532,650 B1 * 3/2003 Kirchdoerffer ..... 29/841

FOREIGN PATENT DOCUMENTS

| | | |
|---|---|---|
| TW | 495089 | 7/2002 |
| TW | 496567 | 7/2002 |
| TW | 551595 | 9/2003 |

* cited by examiner

*Primary Examiner*—Michael A Friedhofer
(74) *Attorney, Agent, or Firm*—Birch, Stewart, Kolasch & Birch, LLP

(57) ABSTRACT

A waterproof structure for switch pins includes a pin exposed outside a switch to be connected to an electric wire. The pin and the electric wire are covered by a waterproof insulation material through an injection forming process to become an integrated manner. The pin and electric wire are fully waterproof. The electric wire also can be fastened firmly to the pin to prevent separation of the two.

12 Claims, 6 Drawing Sheets

WATERPROOF STRUCTURE FOR SWITCH PINS

FIELD OF THE INVENTION

The present invention relates to a switch and particularly to a switch that has waterproof pins.

BACKGROUND OF THE INVENTION

Water is one of the factors that causes short circuit of electronic elements. As water can permeate easily, even the electronic element that is protected by a casing could be damaged by seeping of water. The switch to conduct electric current could result in fire breakout due to exposure to water. The consequence is serious.

To remedy the aforesaid problem, many waterproof switches have been developed. R.O.C. patent No. 496567 discloses a waterproof switch which mainly has a waterproof washer in a main body to prevent water from entering in the circuit located inside.

Other references of waterproof switch design can be found in R.O.C patent Nos. 551595 and 495089 and the like. They all use a washer in the switch body to achieve waterproof effect. However, they all aim to provide waterproof function for the interior of the body. The connection juncture between pins and electric wires also is an important spot. Whatever waterproof effect of the waterproof washer, short circuit occurred to the connection juncture of the waterproof switch pins and electric wires also causes damage of the switch and results in unforeseeable loss. There is a conventional method which adopts a heat-shrinking tube to encase the exposed core of the pin and electric wire to achieve an insulation effect. But it cannot fully seal the pin and electric wire. This is especially true on the connection juncture of the pin and body where insulation is unattainable by the heat-shrinking tube.

Moreover, electric connection effect of the core of electric wire and the pin also is a troubling issue. As the core and the pin are usually bonded by soldering, their connection is not sturdy. In the event that the core is pulled or twisted, the juncture on the pin could fracture or loosen and result in a poor connection.

Refer to FIG. 1 PRIOR ART for a conventional technique to overcome the aforesaid problems. It provides a waterproof structure for switch pins. It has a switch body 10 with a cavity 11 to hold a pin 12. The connection juncture of the pin 12 and an electric wire is located in the cavity 11. After the pin 12 and the electric wire 20 is connected, an insulation material 30 is filled in the cavity 11 to embed the electric wire 20 and pin 12 together, thereby to achieve waterproof effect.

FIG. 2 PRIOR ART shows another conventional technique. It has a shell 40 fastened to an outer end of a switch body 10 where a pin 12 is located. The connection juncture of the pin 12 and an electric wire 20 is covered by the shell 40. The electric wire 20 is extended outside by threading through an opening 41 formed on the shell 40 and switch body 10. Then an insulation material is filled in the shell 40 by injecting in a paste fashion through the opening 41 to seal the connection juncture of the pin 12 and the electric wire 20.

While the two conventional techniques mentioned above can form a sturdy anchoring for the electric wire 20 and fully cover the connection juncture of the electric wire 20 and the pin 12 to achieve waterproof effect, the paste could spill outside. Moreover, injecting the paste manually is slow and often results in unstable quality. It is not economic effective.

SUMMARY OF THE INVENTION

The primary object of the present invention is to solve the aforesaid disadvantages. The invention provides a waterproof insulation material to cover an exposed switch pin and the connection juncture of the pin and an electric wire to isolate water from the connection juncture. The waterproof insulation material further can sturdily hold the electric wire to prevent separation of the electric wire and the pin.

Another object of the invention is to provide a method for manufacturing the waterproof structure of the switch pin. The method includes placing a switch in a mold to form a material injection space on the connection location of the pin and the electric wire; providing a chuck in the mold to anchor the electric wire; and filling a waterproof insulation material in the material injection space through an injection process to form a waterproof structure integrated with the switch. Such a manufacturing method is fast and can achieve a consistent quality. It also can be adapted for automatic production.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
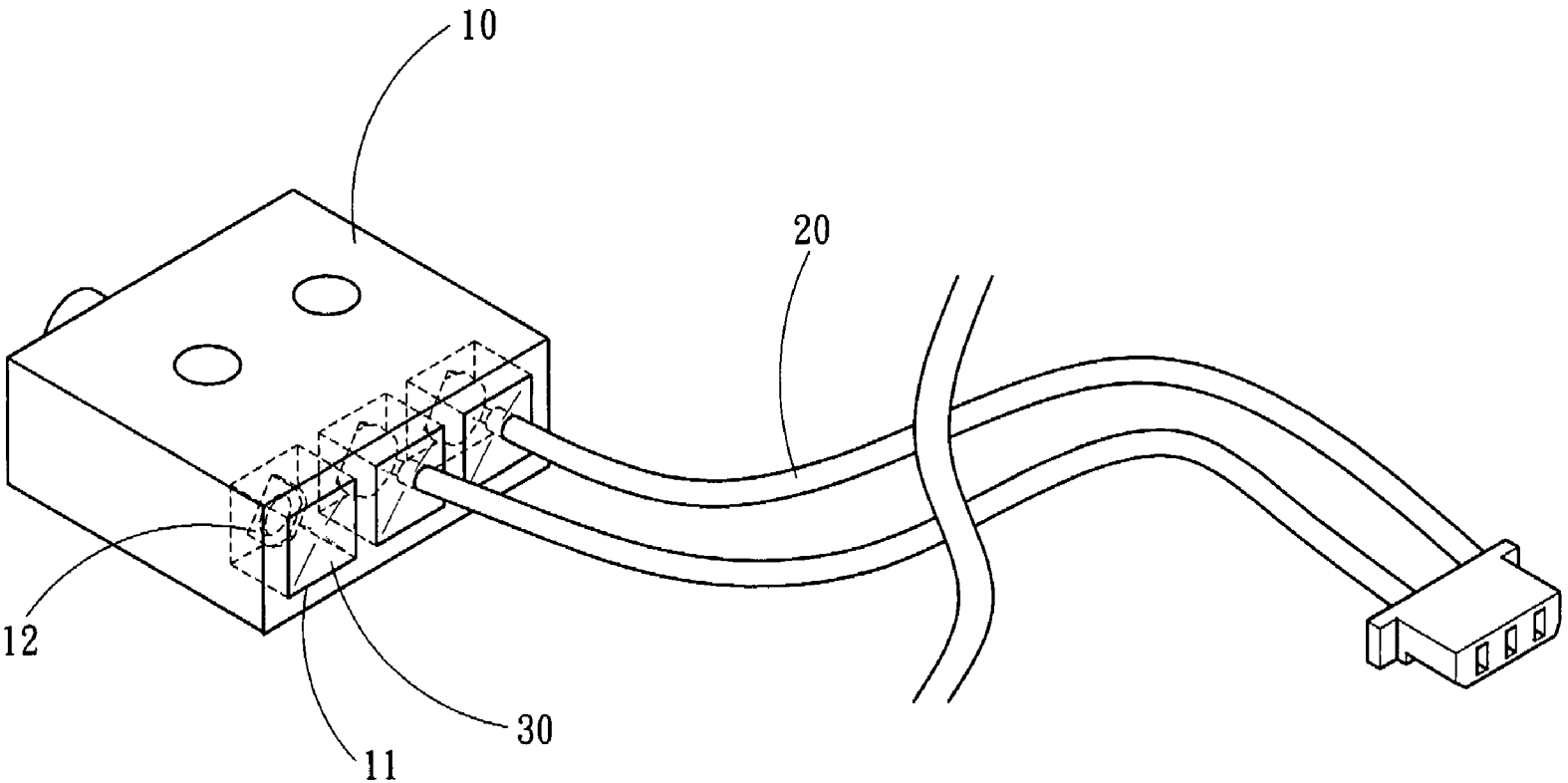
Fig. 1 PRIOR ART
FIG. 1 PRIOR ART is a perspective view of a conventional waterproof switch.
Figure 2:
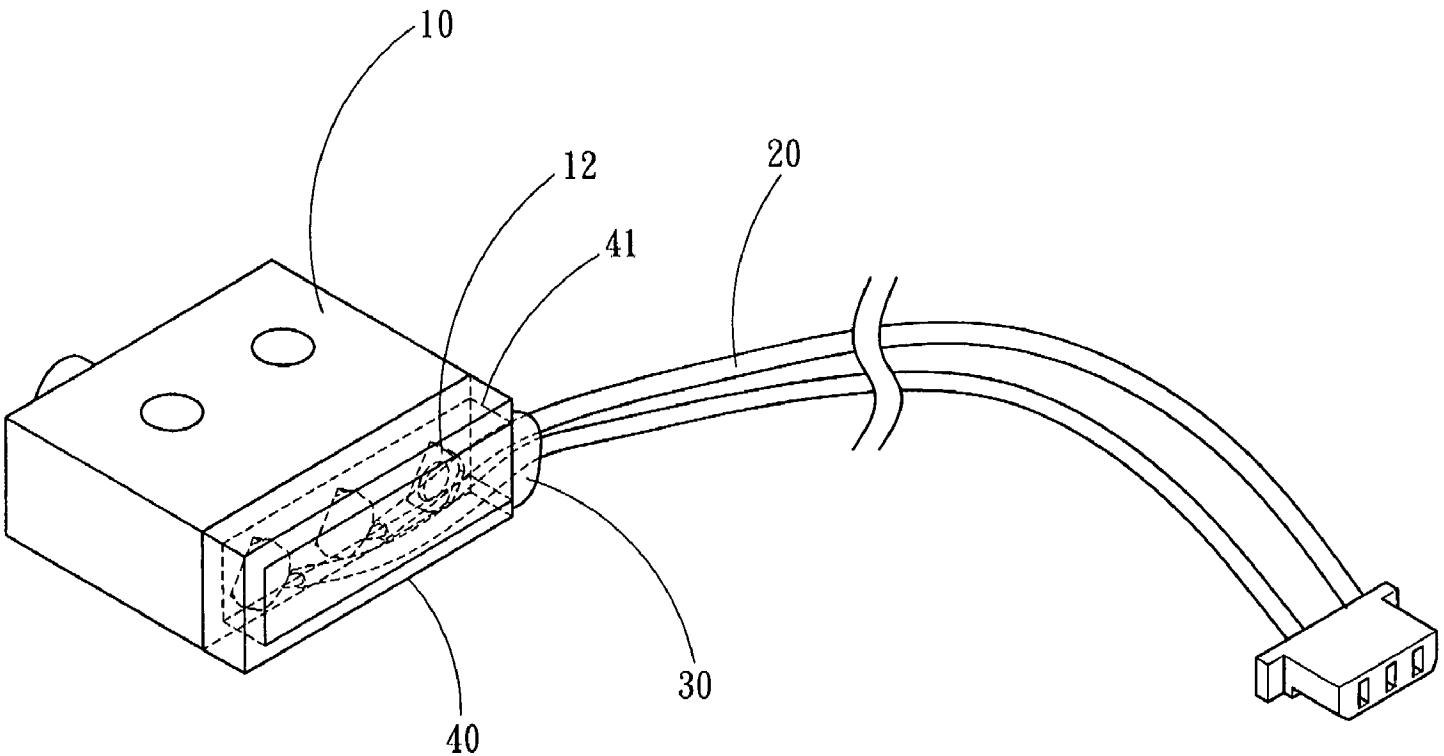
Fig. 2 PRIOR ART
FIG. 2 PRIOR ART is a perspective view of another conventional waterproof switch.
Figure 3:
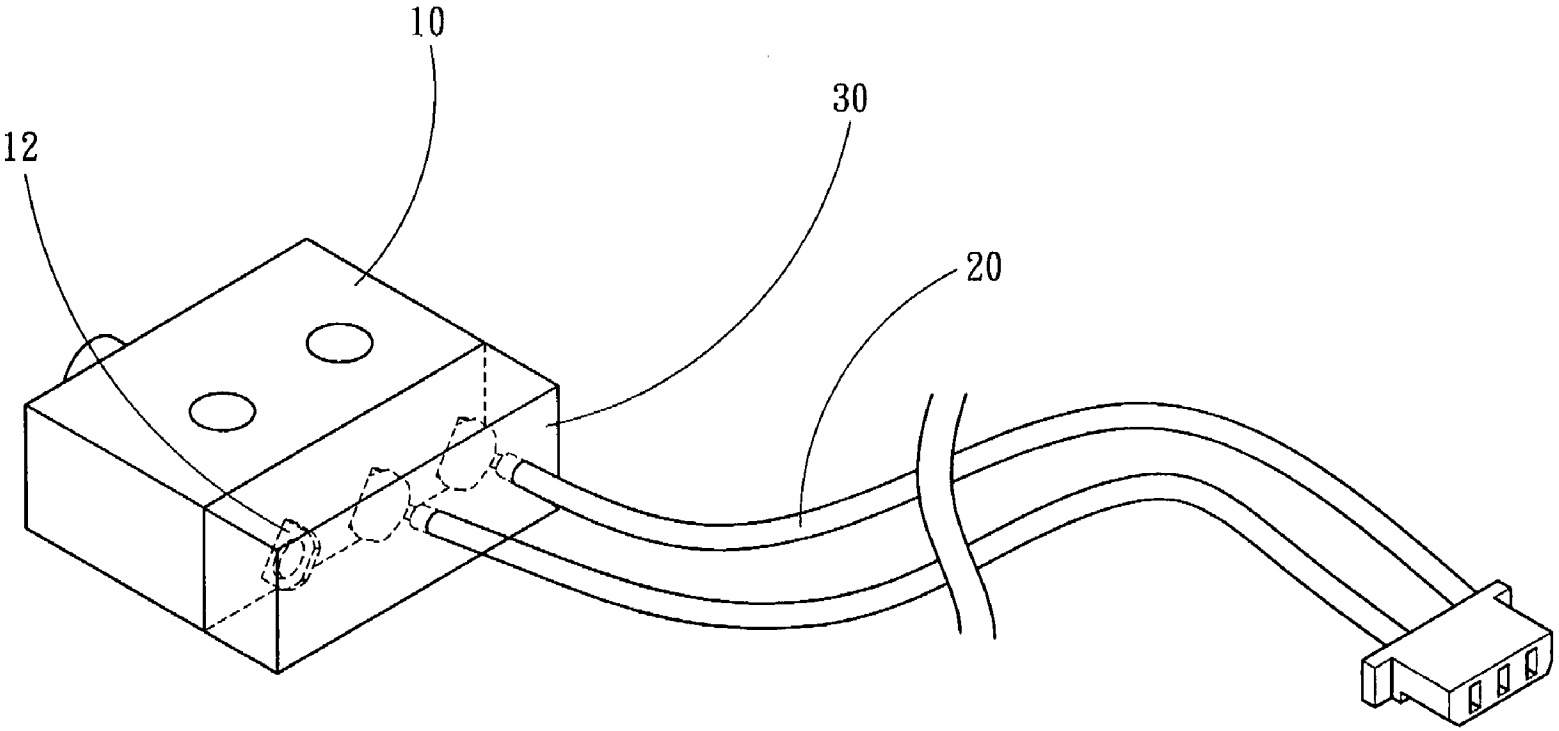
FIG. 3 is a perspective view of the present invention.

The waterproof structure for switch pins of the invention is adopted for use on pins exposed outside a switch to achieve waterproof effect for the connection juncture of the pins and electric wires, and also provide improved anchoring and electric connection for the electric wires. Refer to FIG. 3 for an embodiment of the waterproof structure of the invention adopted on a button switch (the button switch also is waterproof). It includes a switch 10 which contains switch elements inside (not shown in the drawing) to generate and output an electric signal when depressed. The switch elements include a pin 12 extended outside the switch 10. The pin 12 is electrically connected to an electric wire 20 by soldering or insertion. The main feature of the invention is to install a waterproof insulation material 30 (which may be a compatible plastics) to cover the connection juncture of the pin 12 and the electric wire 20 that also covers the insulation layer of the electric wire 20 for a selected distance. Thereby the electric wire 20 can be held and anchored firmly and becomes fully waterproof. The waterproof insulation material 30 is installed on the switch 10 in an integrated manner through an injection forming process so that the entire switch 10 is more consistent to facilitate dimensional planning. The waterproof structure of the invention also is easier and faster to fabricate. Through the injection forming process the waterproof structure can be formed on a plurality of switches 10 by one injection process at a consistent quality.

In addition to providing fast production and consistent quality, the invention also provides an improved manufacturing method. Step 1: fabricate a switch 10 capable of delivering an electric signal. Step 2: electrically connect a pin 12 exposed outside the switch 10 to an electric wire 20.

Figure 4:
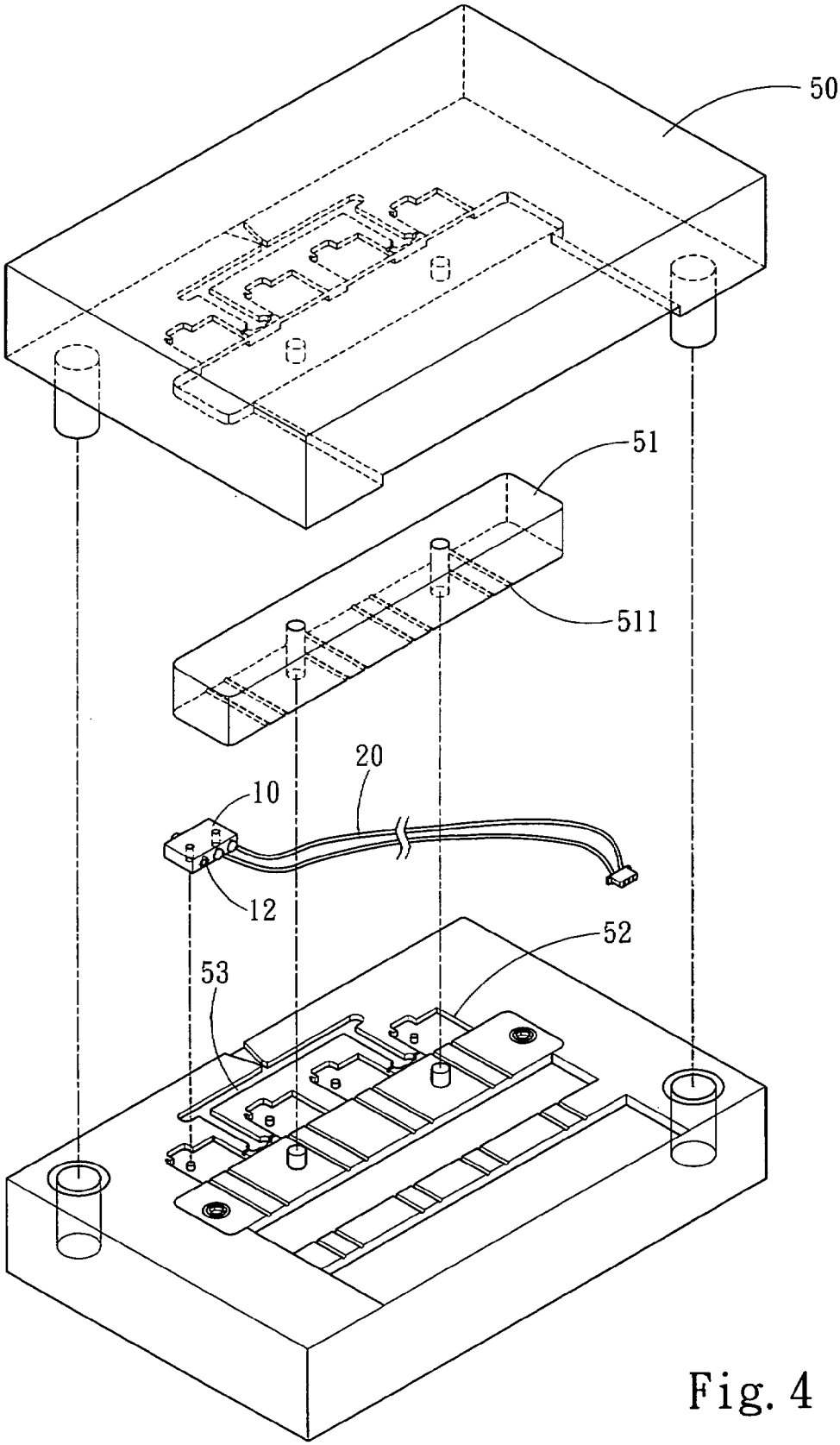
FIGS. 4 and 5 are schematic views of step 3 of the present invention.
Figure 5:
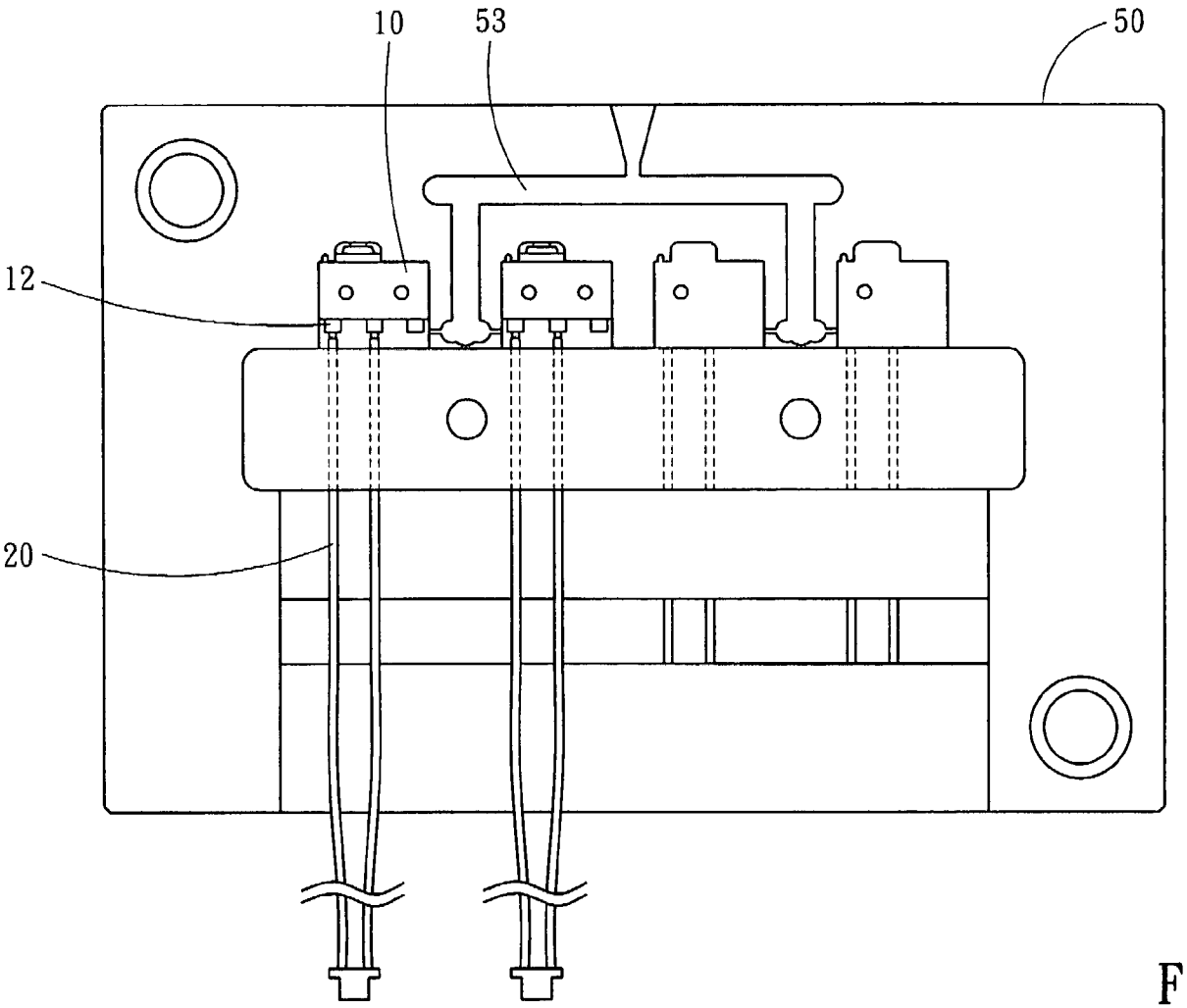

Refer to FIGS. 4 and 5 for step 3: the connected switch 10 and the electric wire 20 are placed in a mold cavity 52 of an injection mold 50, and a material injection space on the connection juncture of the pin 12 and the electric wire 20 is formed; anchor the electric wire 20 with the aid of a chuck 51 located in the mold 50 that has an anchor trough 511 to hold the electric wire 20; cover a upper mold on a lower mold so that the chuck 51 firmly holds and anchors the electric wire 20; inject the waterproof insulation material 30 through an injection passage 53 of the mold 50 under a low pressure injection mode to fill the material injection space with the waterproof insulation material 30 to cover the connection juncture of the pin 12 and the electric wire 20. Thereby the waterproof insulation material 30 and the switch 10 are formed in an integrated manner.

Figure 6:
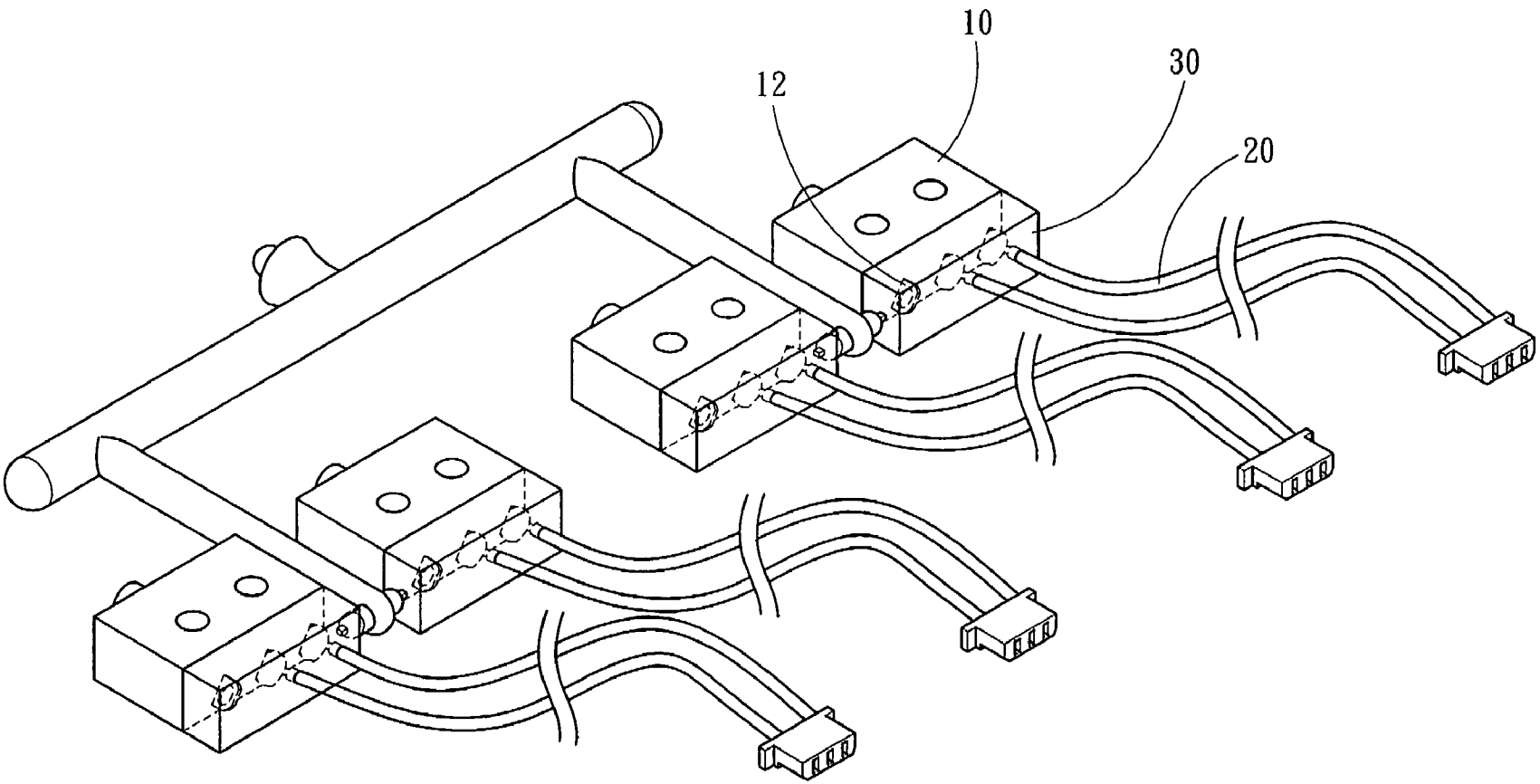
FIG. 6 is a schematic view of finished products after step 3 according to the present invention.

Refer to FIGS. 5 and 6 for the finished products of the switch 10 after step 3. In order to fabricate the waterproof structures for a plurality of the switches 10 by one injection process, the mold 50 has a plurality of material injection passages 53 that share a common material inlet. Each of the material injection passages 53 leads to the material injection space of at least two mold cavities 52. Hence one material injection can make the waterproof insulation material 30 to cover the connection juncture of the pin 12 and electric wire 20 of a plurality of switches 10. Then the finished products of the switches 10 can be removed from the mold 50. Remove the material bars formed on the material injection passages 53 from the switches 10, independent and waterproof switches 10 can be obtained. This method can achieve fast production and consistent quality.

The waterproof structure of the invention can effectively isolate water from the connection juncture of the pin 12 and electric wire 20 of the switch 10. The waterproof insulation material 30 can be formed in a profile matching the switch 10 to give consistency to the entire product. Moreover, the manufacturing method provided by the invention adopts the injection forming process which is fast and can achieve a consistent quality for the waterproof structure. In addition, the manufacturing method of the invention can facilitate automatic production to save labor cost. According to the requirement of the switch 10, the mold 50 may be altered to fabricate the waterproof insulation material 30 at a desired dimension to mate the switch 10 to achieve consistency and facilitate modular production. The problem of paste overflow also can be prevented. It offers a significant improvement over the conventional techniques.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A waterproof structure for switch pins, comprising:

a switch which contains switch elements to generate an electric signal and has at least one pin exposed from one side of the switch to output the electric signal;

at least on electric wire connecting electrically to the at least one pin; and a waterproof insulation material covering a connecting portion of the at least one electric wire and the at least one pin, the waterproof insulation material being integrally formed on the switch through an injection forming process, wherein the switch has a plurality of sides and a rear face, the rear face being adjacent the plurality of sides of the switch, the at least one pin extends from the rear face of the switch, the waterproof insulation material covering the rear face and extending to the sides of the switch to form a flush surface therewith.

2. The waterproof structure for switch pins of claim 1, wherein the switch has a casing made from a plastic material compatible with the waterproof insulation material.

3. A method for manufacturing the waterproof structure of claim 1, comprising the steps of:

fabricating the switch to output the electric signal;

connecting electrically the at least one electric wire with the at least one pin exposed outside the switch; and placing the connected switch and the at least one electric wire in an injection mold and injecting the waterproof insulation material through the injection forming process to cover the connecting portion of the switch and the electric wire.

4. The method of claim 3, wherein the switch has a casing made from a plastic material compatible with the waterproof insulation material.

5. The method of claim 3, wherein the waterproof insulation material is injected through a low pressure injection forming process.

6. The method of claim 3, wherein the switch has a plurality of sides and a rear face, the rear face being adjacent the plurality of sides of the switch, the at least one pin extends from the rear face of the switch, the waterproof insulation material covering the rear face and extending to the sides of the switch to form a flush surface therewith.

7. The method of claim 3, wherein the waterproof insulation material is only in contact with the switch at a face of the switch from which the at least one pin extends.

8. The method of claim 7, wherein the waterproof insulation material is exposed to ambient environment except at the surface which contacts the face of the switch, the face of the switch being flat.

9. The method of claim 3, wherein the waterproof insulation material has a plurality of slides with only one side thereof being in contact with the switch, the waterproof insulation material being flush with the switch.

10. The waterproof structure of claim 1, wherein an the waterproof insulation material is only in contact with the switch at a face of the switch from which the at least one pin extends.

11. The waterproof structure of claim 10, wherein the waterproof insulation material is exposed to ambient environment except at the surface which contacts the face of the switch, the face of the switch being flat.

12. The waterproof structure of claim 1, wherein the waterproof insulation material has a plurality of sides with only one side thereof being in contact with the switch, the waterproof insulation material being flush with the switch.

* * * * *